US008152463B2

(12) United States Patent
Haselbach et al.

(10) Patent No.: US 8,152,463 B2
(45) Date of Patent: Apr. 10, 2012

(54) METHOD FOR IMPINGEMENT AIR COOLING FOR GAS TURBINES

(75) Inventors: Frank Haselbach, Melbourne (GB); Erik Janke, Berlin (DE); Jens Taege, Berlin (DE); Timm Janetzke, Berlin (DE); Wolfgang Nitsche, Neuwerder (DE); Matthias Reyer, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 1091 days.

(21) Appl. No.: 12/071,156

(22) Filed: Feb. 15, 2008

(65) Prior Publication Data

US 2008/0226441 A1 Sep. 18, 2008

(30) Foreign Application Priority Data

Feb. 16, 2007 (DE) ..... 10 2007 008 319

(51) Int. Cl.
*F01D 5/18* (2006.01)

(52) U.S. Cl. ..... 416/1; 416/96 R; 416/97 R; 415/115

(58) Field of Classification Search ..... 415/115, 415/116; 416/95.96 R, 95, 96 R, 1, 97 R
See application file for complete search history.

(56) References Cited

U.S. PATENT DOCUMENTS 3,677,501 A * 7/1972 Denning ..... 244/12.5
4,095,417 A * 6/1978 Banthin ..... 60/39.5
5,060,867 A * 10/1991 Luxton et al. ..... 239/428.5
5,391,052 A * 2/1995 Correia et al. ..... 415/115
5,467,815 A 11/1995 Haumann et al.
5,586,866 A 12/1996 Wettstein
5,735,126 A * 4/1998 Schulte-Werning ..... 60/732
6,122,917 A * 9/2000 Senior ..... 60/752
6,168,380 B1 1/2001 Weigand
6,276,142 B1 8/2001 Pütz
6,439,846 B1 8/2002 Anderson et al.

FOREIGN PATENT DOCUMENTS

DE 42 44 302 A1 6/1994
DE 44 30 302 A1 2/1996
DE 102 02 783 A1 7/2003
EP 0 698 725 A2 2/1996
EP 0698724 2/1996
EP 0889201 1/1999
EP 0892151 1/1999

OTHER PUBLICATIONS

Angela Hilgers, Control and Optimization of Turbulent Jet Mixing, 2000, Center for Turbulence Research, Annual Research Briefs 2000, p. 50.*

* cited by examiner

*Primary Examiner* — Ninh H Nguyen
(74) *Attorney, Agent, or Firm* — Timothy J. Klima; Shuttleworth & Ingersoll, PLC

(57) ABSTRACT

In impingement air cooling of gas turbine components, cooling air velocity packs of a certain amplitude and a given frequency are applied to impingement air openings, with intervallic annular swirl structures being formed which penetrate a cross-flow and hit a component to be cooled with high intensity, thus providing for efficient cooling. In order to obtain annular swirl structures with optimum cooling effect, the Strouhal number, which is determined by a ratio of amplitude, frequency of the velocity packs and size of impingement air cooling openings, ranges between 0.2 and 2.0, and preferably between 0.8 and 1.2.

12 Claims, 1 Drawing Sheet

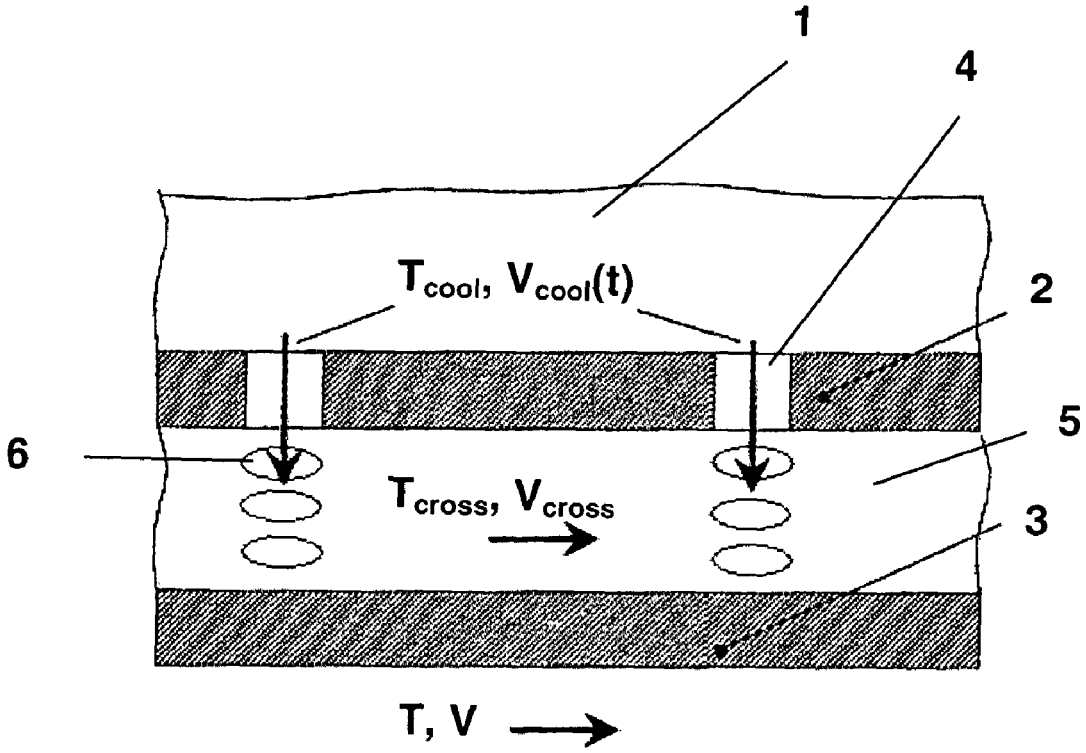
1
4
$T_{cool}$, $V_{cool}(t)$
2
5
6
$T_{cross}$, $V_{cross}$
3
T, V

METHOD FOR IMPINGEMENT AIR COOLING FOR GAS TURBINES

This application claims priority to German Patent Application DE102007008319.1 filed Feb. 16, 2007, the entirety of which is incorporated by reference herein.

This invention relates to a method for impingement air cooling for gas turbines, in which separate jets of cooling air hit a wall area to be cooled via impingement air holes provided in a partition wall.

For gas-turbine engines and stationary gas turbines, it is known to cool the heavily heated components in the area of the turbine, such as rotor blades, stator vanes, liners or combustion chamber walls by using part of the compressor air as impingement cooling air. With impingement cooling, the cooling air is applied—in the form of a continuous air jet—to the area to be cooled via relatively small impingement cooling holes. The strong pressure decrease in the impingement cooling holes produces a strong air jet, which provides for high heat transfer in a locally confined area of the wall surface to be cooled. While impingement air cooling has proved to be one of the most efficient methods for internal cooling of gas turbines, attempts have been made to further improve this cooling principle.

In accordance with Specification EP 0 892 151 A1, a duct provided in the leading edge of a turbine blade is fed, via cooling holes, with impingement air from a main duct supplied with cooling air and flown in longitudinal direction along the blade height. However, this approach fails in optimising the cooling effect of the impingement air jets. In contrast, Specification EP 0 698 724 B1 discloses a special blade design for impingement air cooling of the trailing edge of a turbine blade with the intent to improve the cooling effect of the impinging air which is reduced by cross-flows in the impingement cooling air flows. Specification EP 0 889 201 A1 proposes a specific form of the wall surface to be cooled to improve the cooling effect of the impingement air jets.

On a cooling system for the turbine blades of a gas turbine which is not based on the principle of impingement cooling, it is further known to introduce the cooling air intermittently at a given frequency into the turbine blade to be cooled using a flow oscillator and then discharge the pulsating air jet, upon passing the chambers provided in the blade, to the outside via openings in the blade trailing edge and the blade top edge. The intent of air pulsation in lieu of continuous air supply into the blade interior is to improve convective heat transfer and, thus, the cooling effect of the cooling air supplied.

The present invention, in a broad aspect, provides a method for impingement air cooling of components of a gas turbine subject to hot combustion gases which is capable of improving the cooling effect of the impingement air.

In other words, the basic idea of the present invention is to produce intervallic annular swirl structures in the space between the impingement air holes and the engine component wall to be cooled, in lieu of a continuous impingement air flow, in that cooling air pulses are applied to the entry of the impingement air holes with a certain frequency and amplitude. At a certain amplitude of the cooling air pulses and an accordingly matched size of the cooling air holes, strong annular swirl structures are produced which penetrate the existing cross-flow at the wall surface to be cooled so that, at the respective frequency, cooling air velocity packs or cooling air pulses completely reach the wall surface concerned. As a result of the annular swirls produced at a certain frequency, the temperature gradients at the component wall are, on time average, increased due to the dynamic response behavior of the temperature boundary layer, thus enhancing heat transfer at the wall of the component to be cooled.

The relation between size (D) of the impingement air holes, air velocity ($V_{cool}$) in the impingement air holes (amplitude of cooling air velocity packs) and the frequency (f) at which the cooling air pulses are applied to the impingement air holes is expressed by the so-called Strouhal number $$Sr=f\times D/V_{cool}$$

which preferably ranges between 0.8 and 1.2 and, according to the present invention, can lie between 0.2 and 2.0.

Annular swirl structures with highest intensity for maximum cooling effect are obtained by a correspondingly larger amplitude, preferably at a certain resonance frequency.

The distance between the partition wall and the wall area to be cooled is, according to the present invention, selected such that resonance conditions exist between the annular swirls produced at the impingement air holes and the pressure waves induced and reflected due to the annular swirls, resulting in an intensification of the annular swirl structures.

In an advantageous development of the present invention, the periodic production of the annular swirl structures is interrupted at regular time intervals. The regularly recurrent pauses in the periodic annular swirl production enable the cooling air mass flow to be reduced with the cooling effect remaining constant.

Since the cooling effect is improved by the annular swirl structures of the impingement air produced at a certain frequency, the cooling air requirement is reduced and the efficiency of the turbine, or the service-life of the highly heated turbine components, is increased.

One embodiment of the present invention is more fully described in light of the accompanying drawing.

FIG. 1 shows a partial schematic view of an engine component arranged in a hot gas flow.

In a cavity 1 of an engine component, for example a stator vane of a turbine stage, a cooling air mass flow with temperature $T_{cool}$ is introduced which varies with time, i.e. whose velocity changes periodically, for example sinusoidally, creating intervallic cooling air velocity packs $V_{cool}(t)$ with a certain amplitude $V_{cool}$. A hot gas with temperature T and velocity V flows along the outer wall 3 of the engine component to be cooled. Arranged in the cavity 1 and at a certain distance from the outer wall 3 is a partition wall 2 with impingement air openings 4 to which the intervallic velocity packs $V_{cool}(t)$ of the non-continuous cooling air mass flow are applied. The cooling air reaches the inner surface of the outer wall 3 and flows, as a cross-flow with velocity $V_{cross}$ and temperature $T_{cross}$ in the cooling air duct 5 formed between the outer wall 3 and the partition wall 2, and then to the outside via openings not shown, for example film cooling holes. The cooling air velocity packs $V_{cool}(t)$ periodically applied to the impingement air openings 4 lead at their exits, upon impingement onto the cross-flow, to the formation of periodically successive, strong annular swirl structures 6. The annular swirl structures 6 of the cooling air are capable of essentially completely penetrating the cooling air duct 5 between the partition wall and the outer wall or the cross-flow existing therein, respectively, thus hitting the inner surface of the outer wall 3 with high intensity and cooling it more effectively than the continuous impingement air flow provided by the state of the art.

Due to the high efficiency of the non-continuous impingement air cooling, the service-life of the respective turbine components is increased with the same cooling air requirement, or the cooling air requirement is reduced and the efficiency of the turbine improved. The new cooling method can be applied to stationary gas turbines and gas-turbine engines for impingement air cooling of rotor blades, stator vanes, liners and platforms, as well as turbine and combustion chamber casings.

For the formation of maximally strong annular swirl structures 6 with high impingement cooling effect, it is necessary that size, or diameter D, of the impingement air opening 4, frequency f of the cooling air velocity packs or the cooling air pulses or swirl separation frequency and amplitude of the flow velocity packs, respectively, and thus the flow velocity of the cooling air in the impingement air openings 4, be suitably set and matched to each other. These three parameters are linked in the Strouhal number Sr, a dimensionless frequency which is the ratio of the product of cooling air pulse frequency and size of the impingement air holes and flow velocity, where $$Sr=f\times D/V_{cool}.$$

Comprehensive test series revealed that, at a Strouhal number Sr in the range of 0.8 to 1.2, strong annular swirl structures of the impingement cooling air are produced with a frequency by which the cooling effect of the impingement air is significantly improved over that of continuous impingement air cooling. Here, the velocity amplitude of the cooling air velocity packs (cooling air pulses) should not fall below a certain value. Intense annular swirl structures are preferably produced under resonance conditions between the annular swirls produced at the impingement air openings and the pressure vibrations building up at the component wall and the partition wall as a result of the occurrence of annular swirls.

| List of reference numerals | |
|---|---|
| 1 | Cavity of a turbine component |
| 2 | Partition wall in 1 |
| 3 | Outer wall of 1 |
| 4 | Impingement air openings in 2 |
| 5 | Cooling air duct between 2 and 3 |
| 6 | Annular swirl structures |
| $V_{cool}$ (t) | Cooling air velocity pack |
| $V_{cool}$ | Cooling air velocity, amplitude of $V_{cool}$ (t) |
| $T_{cool}$ | Cooling air temperature |
| V | Hot gas velocity |
| $V_{cross}$ | Velocity of cross-flow in 5 |
| D | Size of impingement air opening |
| F | Frequency of $V_{cool}$ (t) or 6, respectively |

What is claimed is:

1. A method for impingement air cooling for gas turbines, comprising:

providing a first partition wall having a plurality of impingement air openings;

providing a separate second wall spaced apart from the first partition wall to form a cooling air duct between the first partition wall and the second wall, the first partition wall separating a cooling air supply from the cooling air duct, the second wall separating the cooling air duct from a hot gas flow;

supplying separate jets of cooling air via the impingement air openings to hit an area of the second wall to impingement cool that area of the second wall;

removing the cooling air from the cooling air duct between the two walls in the form of a cross-flow;

creating intervallic annular swirl structures with high cooling effect in the cross-flow, with these annular swirl structures penetrating the cross-flow with high intensity and frequency and hitting the second wall area to be impingement cooled prior to any mixing of the cooling air and the hot gas flow; and supplying the cooling air to the impingement air openings in cooling air velocity packs ($V_{cool}$ (t)) having a certain amplitude ($V_{cool}$) and frequency (f).

2. The method in accordance with claim 1, wherein the formation and intensity of the annular swirl structures is determined by the amplitude of the cooling air velocity packs and a size (D) of the impingement air openings.

3. The method in accordance with claim 2, wherein the ratio of the frequency (f), the amplitude ($V_{cool}$) of the cooling air velocity packs and the size (D) of the impingement air openings are selected to derive a Strouhal number Sr, for excitation of the annular swirl structures, of between 0.2 and 2.0, where the Strouhal number $Sr=f\times D/V_{cool}$.

4. The method in accordance with claim 3, wherein the derived Strouhal number ranges between 0.8 and 1.2.

5. The method in accordance with claim 4, wherein a distance between the first partition wall and the second wall area to be cooled is selected to create resonance conditions between the annular swirls at the impingement air openings and reflected pressure waves in the cooling air duct, to intensify the annular swirl structures.

6. The method in accordance with claim 5, wherein the periodic generation of the annular swirl structures is interrupted at regular intervals.

7. The method in accordance with claim 1, wherein the ratio of the frequency (f), the amplitude ($V_{cool}$) of the cooling air velocity packs and the size (D) of the impingement air openings are selected to derive a Strouhal number Sr, for excitation of the annular swirl structures, of between 0.2 and 2.0, where the Strouhal number $Sr=f\times D/V_{cool}$.

8. The method in accordance with claim 7, wherein the derived Strouhal number ranges between 0.8 and 1.2.

9. The method in accordance with claim 8, wherein a distance between the first partition wall and the second wall area to be cooled is selected to create resonance conditions between the annular swirls at the impingement air openings and reflected pressure waves in the cooling air duct, to intensify the annular swirl structures.

10. The method in accordance with claim 9, wherein the periodic generation of the annular swirl structures is interrupted at regular intervals.

11. The method in accordance with claim 1, wherein a distance between the first partition wall and the second wall area to be cooled is selected to create resonance conditions between the annular swirls at the impingement air openings and reflected pressure waves in the cooling air duct, to intensify the annular swirl structures.

12. The method in accordance with claim 11, wherein the periodic generation of the annular swirl structures is interrupted at regular intervals.

* * * * *